United States Patent [19]

Scher et al.

[11] Patent Number: 4,782,775

[45] Date of Patent: Nov. 8, 1988

[54] LINEARLY MOVING FEED MECHANISM FOR INTRODUCING AN INTERLINING IN A GARMENT'S WAISTBAND

[75] Inventors: Charles D. Scher, Deerfield; Steven Levy, Skokie, both of Ill.

[73] Assignee: QST Industries, Inc., Chicago, Ill.

[21] Appl. No.: 103,512

[22] Filed: Oct. 1, 1987

[51] Int. Cl.[4] ..... D05B 23/00; D05B 37/04; D05B 97/00

[52] U.S. Cl. ..... 112/121.27; 112/130; 112/305; 112/262.3

[58] Field of Search ..... 112/121.27, 121.26, 112/129, 130, 305, 262.1, 262.3

[56] References Cited

U.S. PATENT DOCUMENTS

| | | | |
|---|---|---|---|
| 1,255,501 | 2/1918 | Barron | 112/130 |
| 1,365,282 | 1/1921 | Scott | 112/130 |
| 2,070,200 | 2/1937 | Ernst | 112/130 |
| 3,381,639 | 5/1968 | Miller | 112/121.27 X |
| 3,515,081 | 6/1970 | Miller | 112/121.27 X |
| 3,972,296 | 8/1976 | Marforio | 112/121.27 |
| 4,048,931 | 9/1977 | Hodgins | 112/121.27 |

*Primary Examiner*—H. Hampton Hunter

*Attorney, Agent, or Firm*—Eugene F. Friedman

[57] ABSTRACT

A device and method for linearly inserting an interlining into the formation of a waistband of a garment such as slacks. The device has separate guiding means which directs different strips of fabric into a sewing mechanism which, in turn, combines the waistband components. One of the fabrics constitutes the interlining which prevents the waistband from rolling over in use. The guide for feeding the interlining into the sewing mechanism utilizes a linearly moving air cylinder. Pins on a holder pivotally connected to the cylinder attach to the interlining and feed it directly into the sewing mechnism. As a result, the pins and the interlining move linearly toward the sewing mechanism. As the cylinder returns to its starting position, the holder pivots to release the pins from the material to avoid pulling the interlining away from the sewing mechanism. Lastly, a knife connects to a second cylinder through a chain link. After the inclusion of the desired amount of interlining in the waistband, the knife severs the former. The two cylinders operate under the control of a foot pedal. Pressing the pedal the first time inserts the lining into the sewing mechanism and pressing it a second time cuts the interlining.

25 Claims, 5 Drawing Sheets

FIG. 8
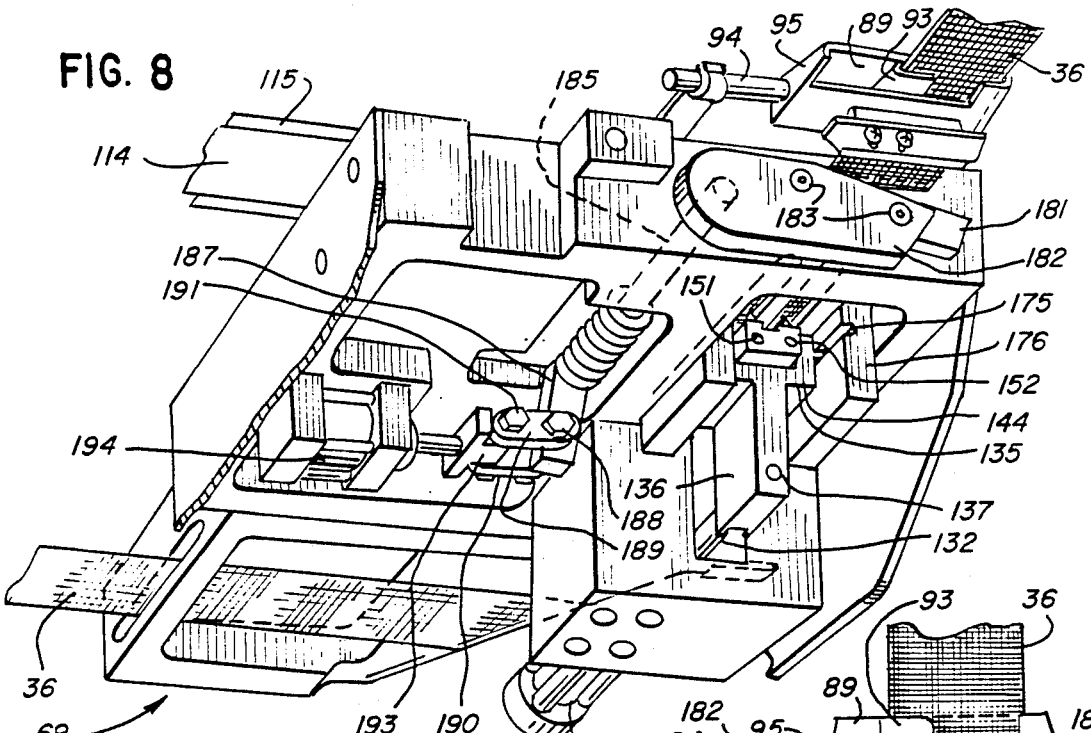
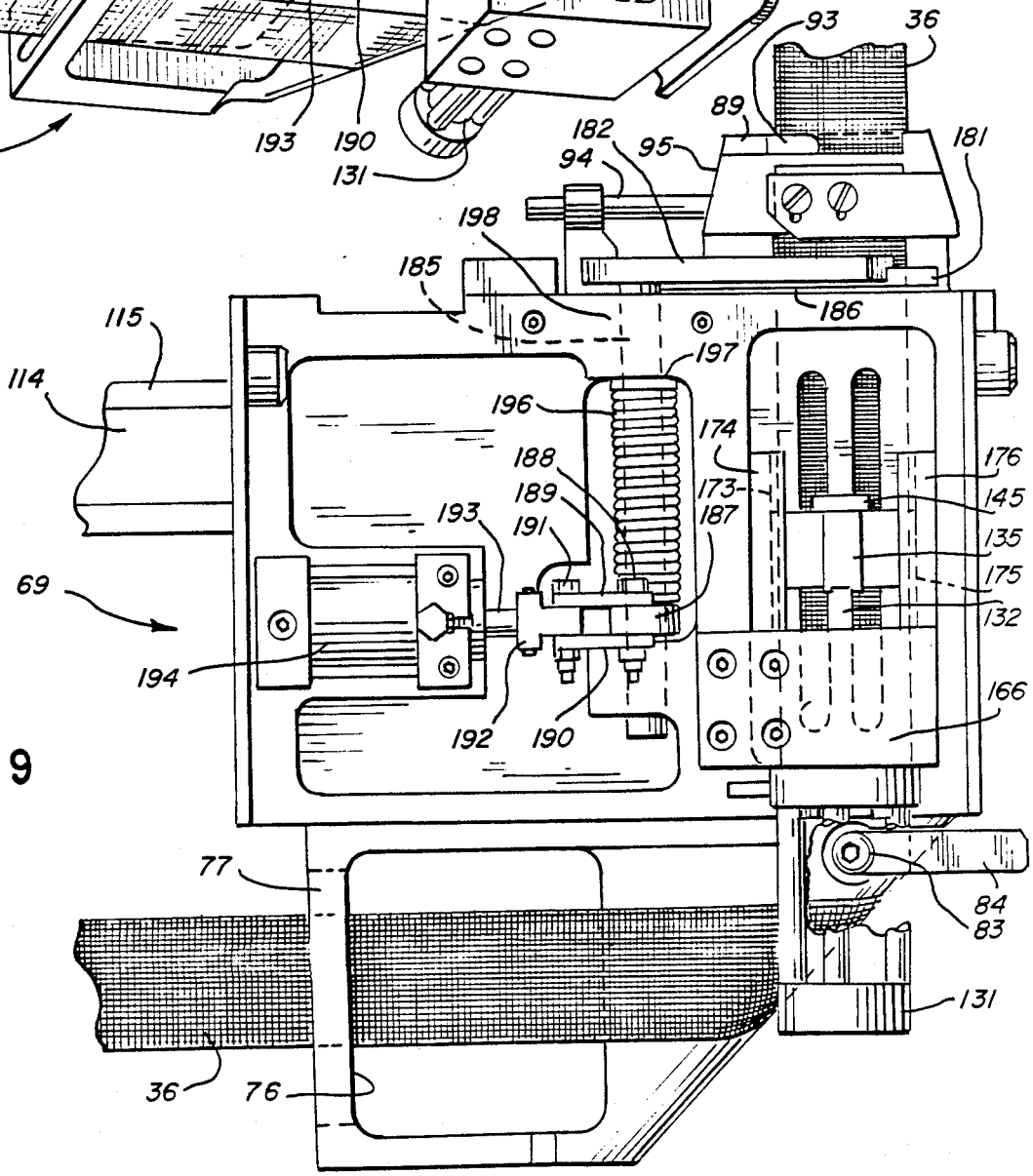
FIG. 9

LINEARLY MOVING FEED MECHANISM FOR INTRODUCING AN INTERLINING IN A GARMENT'S WAISTBAND

BACKGROUND

The manufacture of various garments, especially men's slacks, involves the combining of various fabrics into the complicated structure of the waistband. As an example, FIG. 1 shows the pair of slacks at 20 with the waistband 21.

As seen in FIG. 2, the typical waistband construction 21 includes a multitude of layers. Two sewing steps serve to create the particular waistband 21 shown in FIG. 2.

The first sewing provides the lines of stitches 22. The stitches 22 attach the ribbing, or identifying strip, of satin 23 to the outer layer 24 generally composed of a biascut pocketing material. The lines of stitches 23 also secures to the outer layer 24 the backing 25 formed of a nonwoven fabric such as Polyastro® sold by QST Industries, Inc., of Chicago, Ill.

Lastly, the stitches 23 also attach the sewing tab 26 to the outer and backing layers 24 and 25, respectively. The sewing tab takes the form typically of a bias-cut canvas material which provides a blind tab to attach such items as belt loops. The resulting construction achieved by the first stitching 23 and composed primarily of the outer layer 24, the backing 25, and the sewing tab 26, in combination, bear the label of the waistband curtain.

The second sewing step occurs along the zigzag line of stitches 30 and completes the preparation of the waistband 21. In traveling from the inside of the waistband 21, as seen in FIG. 2 and as would appear in an actual pair of slacks, the stitches 30 attach first the shell fabric 31 and the sewing guide material 32 between the tops of the outer layer 24 and the backing layer 25. The shell fabric 31, of course, represents the actual visible material of the slacks 20.

The sewing guide material 32 includes the rows of slots 33 and 34 and facilitates the construction of the pants 20. The bottom row of slots 34 assist in folding the sewing guide material 32, and thus the shell fabric 31, over the material remaining on the top of the waistband. In particular, the row of slots 34 provides less resistance to the folding. Thus, the construction of the garment involves folding over the sewing guide material 32 and the shell fabric 31 at the row of lower row slots 34 to establish the top of the garment at the desired location.

The upper row of slots 33 provides a line of less resistance for the folding under of the edge of the sewing guide material 32 and thus the shell fabric 31. Again, the slots 33 establish a straight line for the bottom edge necessary to produce the waistband 21 as seen in FIG. 20. A good example of the sewing guide material bears the trademark of "Edge Control" ® from QST Industries, Inc.

Finally, the zigzag stitching 31 attaches the important strip of interlining material 36 on the outside of the waistband construction 21. The strip 36 bears the very important function of preventing, totally or at least largely, the rolling over of the top of the waistband 21 as the person wearing the garment 20 goes through his normal motions of bending over, sitting, and the like. The interlining 36 may take various forms. The material 36 shown in FIG. 3 results from weaving warp and fill yarns together where the latter displays a substantial resistance to bending or folding. A prime example of this type of rollresistance strip appears under the mark of "BAN-ROL" ®, sold by QST Industries, Inc., and has found industry-wide acceptance.

As seen in FIG. 1, however, the interlining strips 36 need not extend the entire length of the waistband 21. The back 37 of the garment often has little need for this material.

Thus the second sewing step, which results in the of stitching 30, combines the four layers of the shell fabric 31, the sewing control material 32, the rollover-resisting interlining 36, and the curtain. The latter includes the outer layer 24, the backing material 25, the sewing tab 26 and, optionally, the ribbing 23 held together by the stitching 22.

In particular, the stitching 30 requires the insertion and cutting of the interlining 36 at the desired locations. Obviously, the manual cutting and insertion of the interlining 36 at the desired locations as seen in FIG. 2 would require the expenditure of substantial time and effort. This, concomitantly, would increase the cost of the final garment to the purchaser. Accordingly, various developments have attempted to simplify and expedite this step in the construction of the waistband.

One example of a mechanism for bringing together the materials used in the final stitching 30 appears in U.S. Pat. No. 3,515,081, to S. E. Miller. That patent shows a device for feeding two strips of material into the sewing area of a machine from rolls suspended overhead. It thus requires the utilization of extensive, curved guides to bring the material into the sewing vicinity for attachment to the waistband. The device also employs air cylinders with pivoting, sharpened feeddogs to move the material through the curved guides. The feeddogs, when the cylinder moves towards the sewing area, engage the strip of material in question to move it in the appropriate direction. When the piston moves in the opposite direction, the feeddogs pivot in a manner to cause them to slide backward over the material to prevent them from dragging it away from the sewing needle.

Miller's device constitutes a rather significant improvement for feeding strips of material to the sewing needle. However, the curved path traveled by the strips of material to the sewing area resulted in the sections of material having imprecise locations in the waistbands themselves. Furthermore, the holder of the feeddogs, attached at the ends of the pistons, could easily fall out of alignment and thus not perform their jobs properly. Additionally, the overhead location required of this mechanism tended to obscure the operational and viewing area of the seamstress, thus interferring with her work.

A subsequent device attempted to feed various strips of material to the sewing area along a straight line from directly in front of the machine. Air cylinders caused feeddogs located in front of and under the sewing area to pass through arcs. During the motion through this arc, the feeddogs would engage the interlining for a waistband and feed it to the sewing area. A knife forming part of the mechanism would move to cut off the strip of interlining when directed by the operator.

In effect, the device converted the linear motion of an air cylinder into the circular motion of the feeddogs. This in turn created substantial impreciseness in the exact location of the beginnings and the ends of the strips of interlining fed into the waistband. The device, accordingly, although a substantial improvement over the mechanisms it replaced, still proved imperfect.

Thus, various devices developed in the past have reduced the time and cost of creating a waistband for a garment. Yet, the search continues for a device that will accomplish these results while providing precision to the placement of the portions of interlining included within a waistband.

SUMMARY

Typically, a device for feeding a plurality of fabric strips to a sewing mechanism includes a first guiding device which directs a first strip of fabric to the sewing area. A second guiding device similarly directs a second strip of fabric to the sewing mechanism. In particular, the second device includes an injector for moving the second strip a predetermined distance in a particular linear direction toward the sewing mechanism. It also has a cutting device which severs a portion of the second strip near the sewing mechanism from the remainder of the second strip.

An improved feeding device results where the injector includes first a transporting mechanism. This component moves in a substantially straight line in the particular linear direction toward the sewing mechanism over the required predetermined distance. After moving in a straight line over the desired distance, the transporting device moves away from the sewing mechanism.

Lastly, the injector includes a gripping device which connects to and moves with the transporter. When the transporter moves in the particular linear direction, the gripper attaches to a particular location on the second strip of fabric and moves it in the particular linear direction.

The method of feeding fabric strips to a sewing mechanism typically includes directing several strips of fabric to the sewing area. Doing so for one of the strips involves moving that strip a predeterminate distance in a particular linear direction toward the sewing mechanism. Additionally, a portion of the strip is then severed from the remainder of the strip near the sewing mechanism.

An improvement in this method results if the step of moving the strip over the predetermined distance begins with attaching a gripping device to a particular location on the strip. Subsequently, the gripping device should move a predetermined distance in the particular, desired linear direction. Naturally, the strip of material attaches to the gripping device and moves with it to the sewing area.

BRIEF DESCRIPTION OF THE FIGURES

FIG. 8 gives a bottom isometric view of an interlining guide mechanism.

FIG. 9 gives a bottom plan view of an interlining guide mechanism.

DETAILED DESCRIPTION

Figure 1:
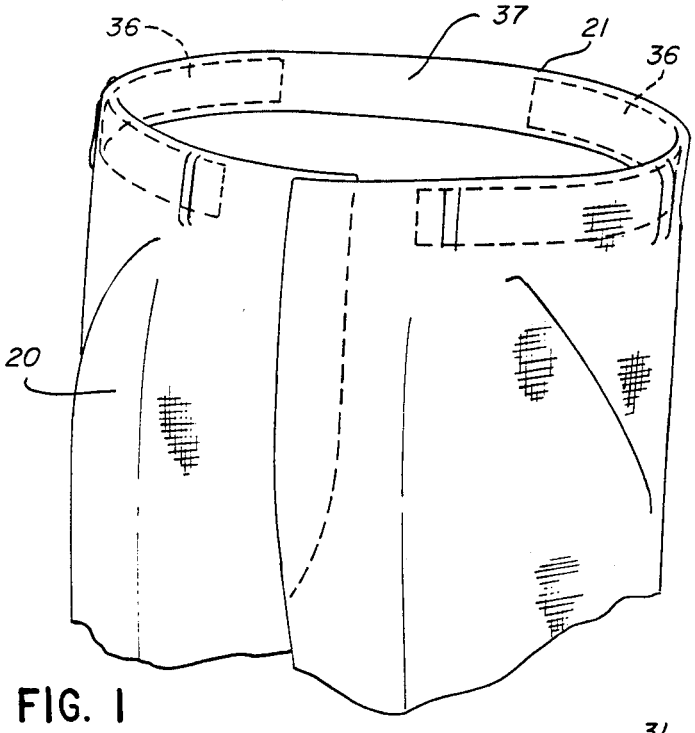
FIG. 1 shows a pair of slacks incorporating a waistband.
Figure 3:
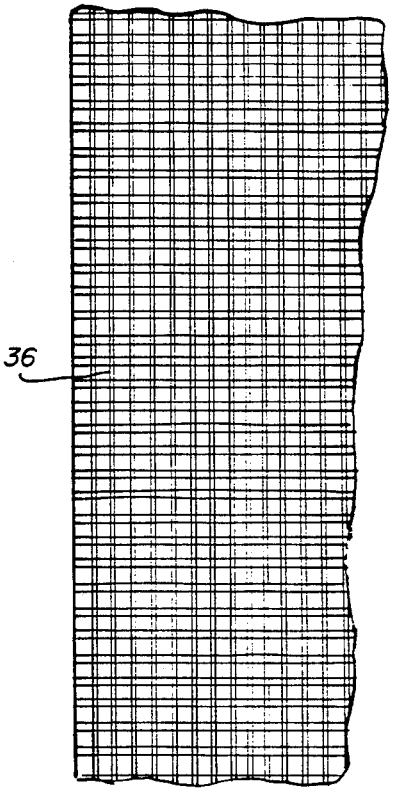
FIG. 3 shows a portion of a strip of interlining used to prevent the tops of waistband on slacks from rolling over.
Figure 2:
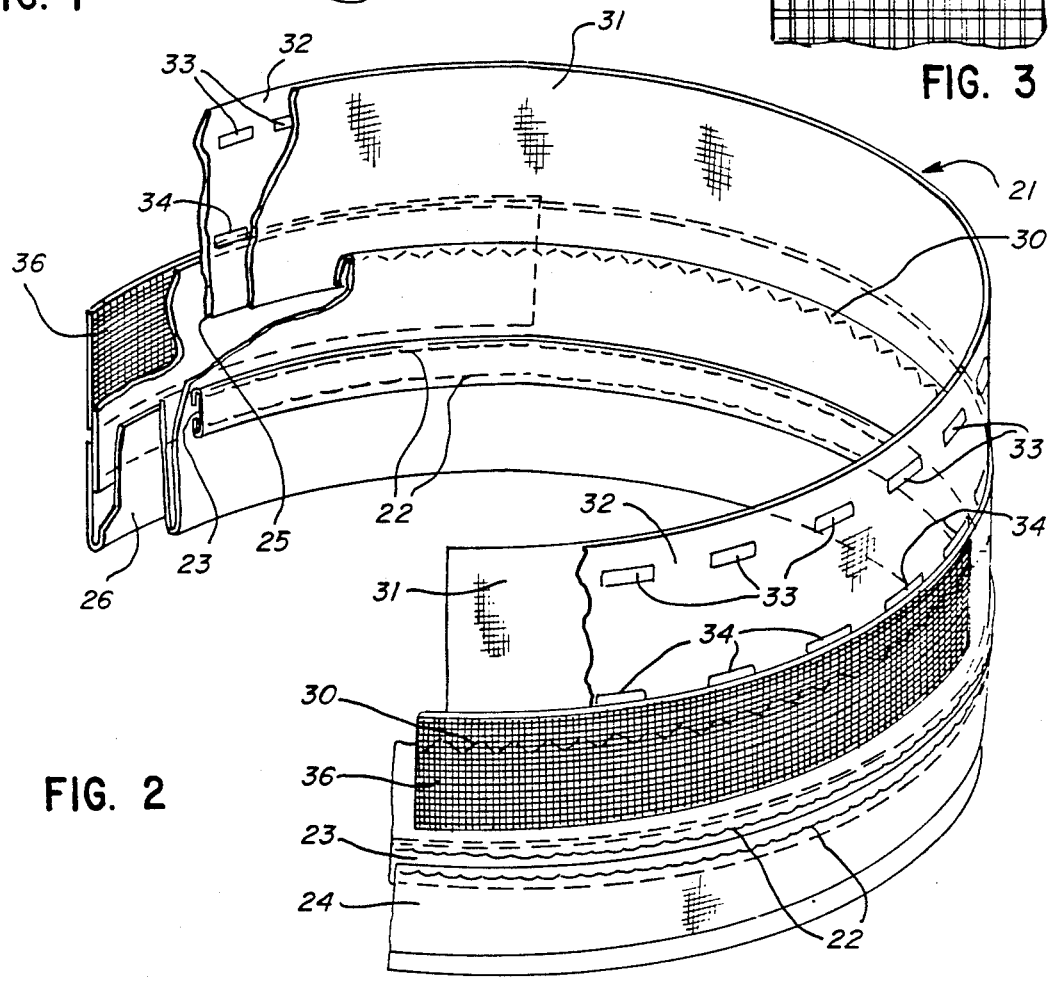
FIG. 2 displays, in a partially cut-away view, various components of a typical waistband included on slacks.
Figure 4:
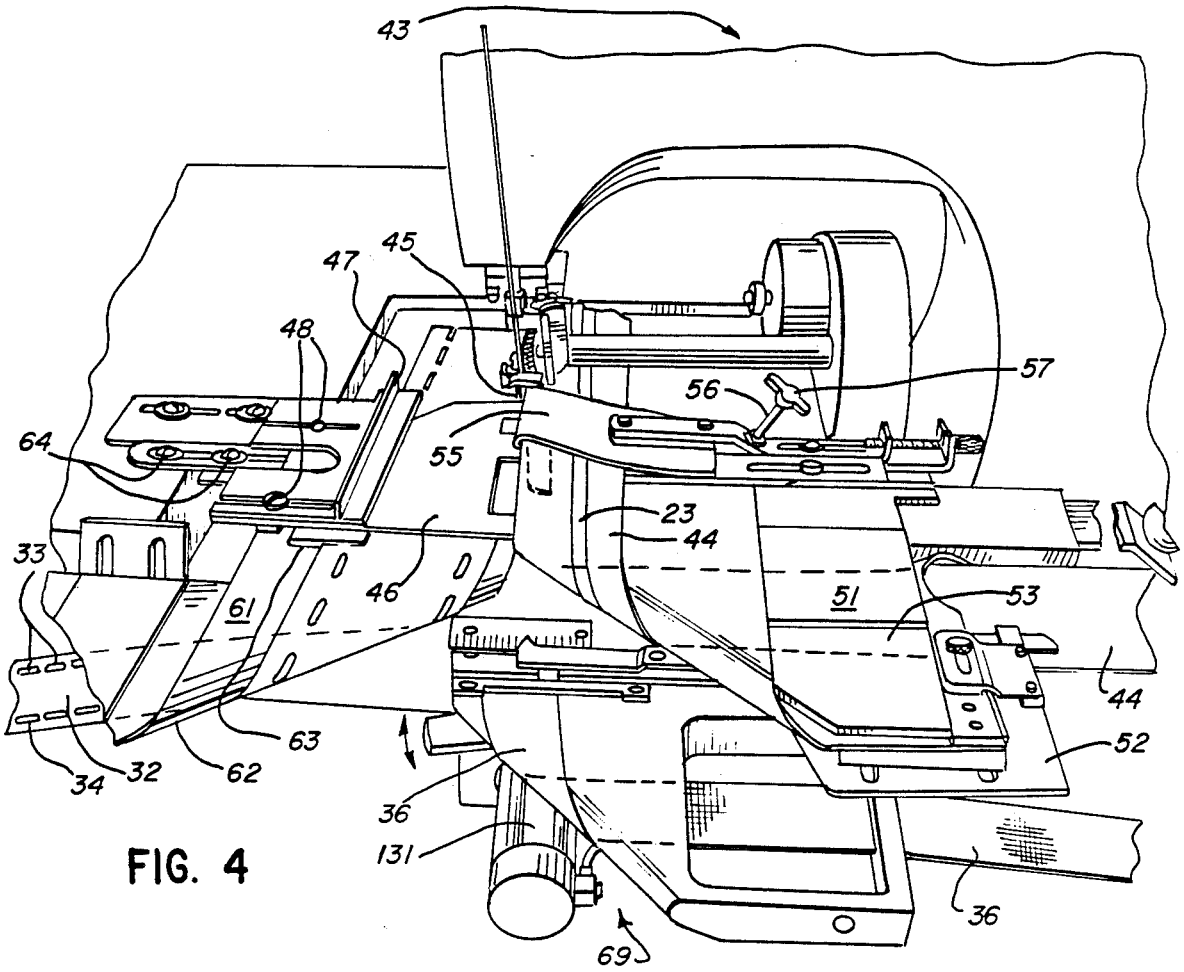
FIG. 4 shows a sewing machine combining together several components to form a waistband for slacks.

The BACKGROUND contains a discussion of the waistband with its various components seen in FIGS. 1 to 3. In FIG. 4, the sewing machine shown generally at 43 serves to combine the various components into the waistband 21 of the prior figures. Specifically, the machine 43 will sew the stitching 30 which unites the waistband curtain 44, the sewing guide material 33, and the interlining 36. At the same time, it will include a strip of the shell fabric, not shown in the figure, into the waistband.

In particular, various components must arrive at the sewing needle 45 having their correct relative orientations to insure the production of the desired waistband. Thus, the operator manually lays the strip of shell fabric 31, seen in FIG. 2, onto the plate 46 in FIG. 4. The ridge 47 places the strip of shell fabric at the correct location for sewing at the needle 45. The screws 48 permit the adjustment of the location of the ridge 47 for the proper placement of the shell fabric.

Next, the guide 51 feeds the waistband curtain 44 to the needle 45. Specifically, the curtain 44 passes between the lower plate 52 and the upper plate 53 and up and around the rounded 45° edge 54. It then passes through the guide plate 55 which properly aligns it for the sewing needle 45. The bolt 56 with the wing top 57 permits the adjustment of the plate 55 to assure the proper guidance of the curtain 44.

The curtain 44 passes to the sewing needle 45 as a continuous strip. Accordingly, the guide mechanism 51 for that component does not need to incorporate a cutting device to stop the feeding of the curtain 44. Upon the completion of a waistband, the operator will manually cut the curtain 44 on the far side of the sewing needle 45.

Similarly, the guide mechanism 61 brings the sewing guide material 32 around the 45° rounded edge 62, under the plate 46, and to the needle 45. The guide edge 63 properly aligns the material 32 so that it feeds to the correct position at the needle 45. The screws 64 permit the adjustment of the guide edge 63 so that it may accommodate different widths of sewing strip material 32.

As with the waistband curtain 44, the guidestrip material 32 feeds continuously to the needle 45. After the completion of the waistband, the operator will also cut the sewing guide strip 32 when she cuts the waistband curtain 44 on the far side of the needle 45.

Lastly, the guide mechanism, indicated generally at 69, guides the strip of interlining 36 to the needle 45. It also cuts the strip 36 into segments and makes sure that the segments have the desired locations in the waistband.

Figure 5:
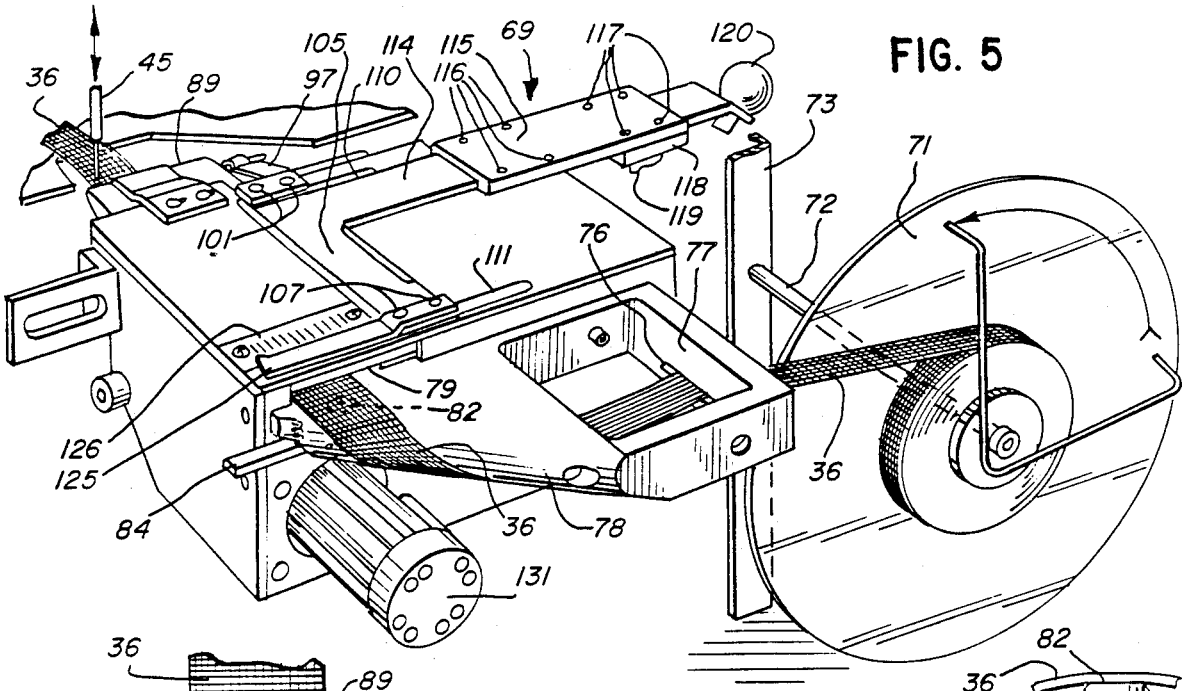
FIG. 5 gives an isometric view of a guide mechanism for injecting segments of a strip of interlining into a waistband for slacks.
Figure 6:
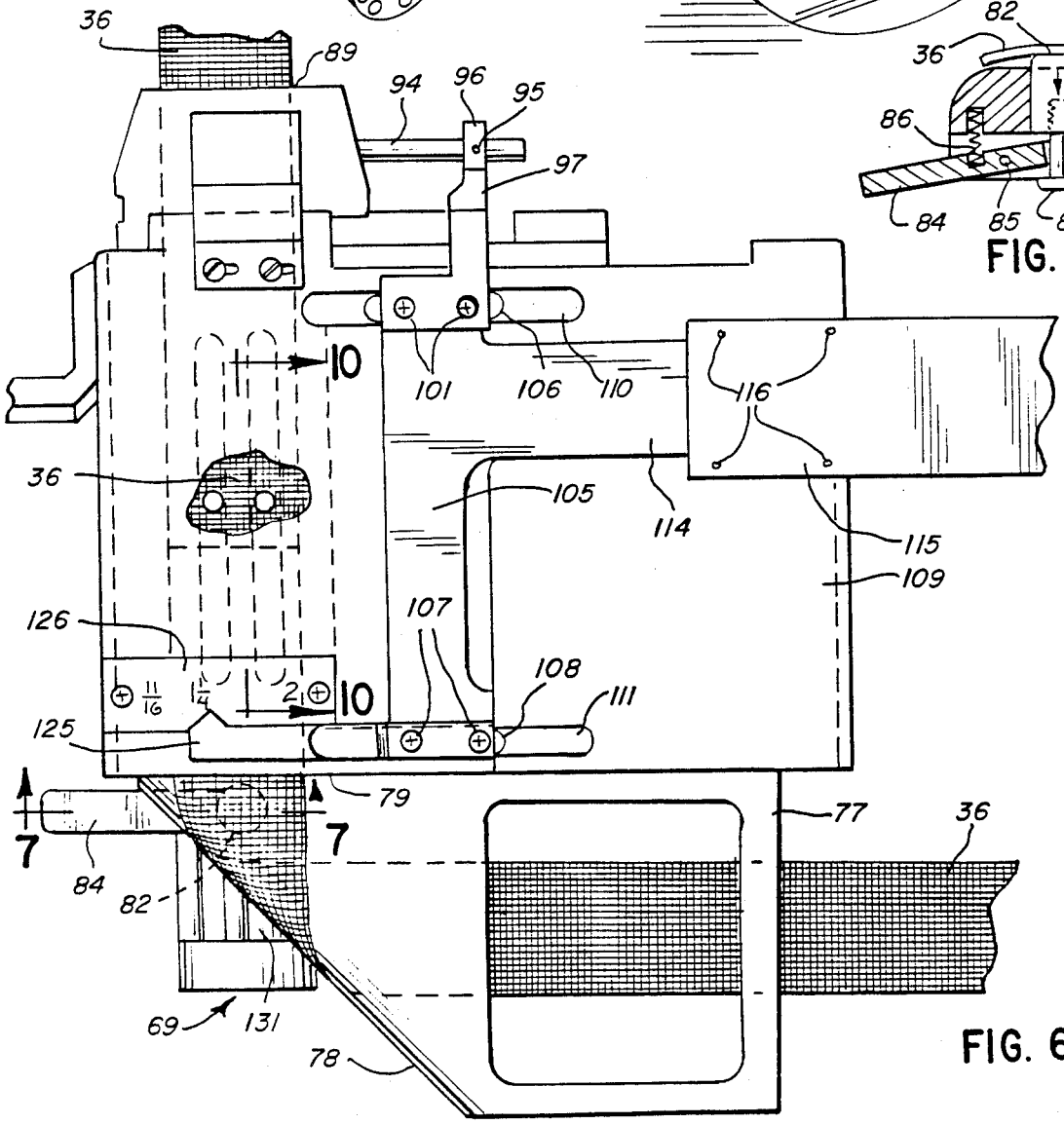
FIG. 6 gives a top plan view of the interlining guide mechanism of FIG. 5.

Removing the guide plate 46 and the guides 51 and 61 in FIG. 4 permits the clearer view of the interlining guide mechanism 69 seen in FIGS. 5 and 6. As seen there, the strip of interlining 36 emanates from the spool held in place by the rod 72 connected to the bracket 73. From there, the strip 36 passes through the opening 76 in the material guide 77. It then climbs over the 45° rounded edge 78 and into the inlet opening 79.

Before reaching the opening 79, however, the interlining strip 36 must pass over the button 82. The button 82, as seen in FIGS. 5 and 6, sits in front of and partially obstructs the inlet opening 79. The partial intrusion of the button 82 into the inlet opening 79 minimizes inadvertent motion of the interlining strip 36 either by the operator or by the action of the feed mechanism described below.

Figure 7:
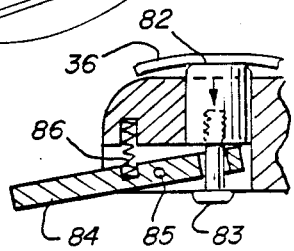
FIG. 7 gives a cross-sectional view along the line 5—5 of the spring biased obstruction button limiting the accidental removal of the interlining from the guide mechanism of FIGS. 5 and 6.

As seen in FIG. 7, the button 82 connects to the screw 83 around which sits the lever arm 84 journaled at the connection 85. The spring 86 biases the left side of the lever 84, as seen in FIG. 7, downwards and thus causes the right end of the lever arm to move upward. This forces the button 82 upward into its protruding position.

The initial insertion of the strip of interlining 36 into the opening 79 requires moving the button 82 out of the way. The operator may accomplish this simply by pressing on the top of the button 82 while inserting the strip 36. Alternately, she may push the end of the lever arm 84 upward. This causes the lever arm 84 to rotate in a clockwise direction about its pivot point 85 and thus push the screw 83 and the button 82 down. As the last item moves in the indicated direction, it departs from the opening inlet 79. Naturally, removing the pressure from either the lever arm 84, or the button 82, permits the spring 86 to bias the button 82 upward into its usual position.

Eventually, the strip 36, under the action of the feed mechanism discussed below, leaves the outlet opening 89 of the guide mechanism 69 in the vicinity of the sewing needle 45. To properly position the interlining strip 36 laterally at the needle 45, the outlet 89 seen in FIGS. 8 and 9, includes the guide edge 93. The guide 93 has freedom of motion in the left and right directions as seen in the figures. It attaches rigidly to the rod 94 which passes through the side 95 of the outlet 89. Moving the rod 94 serves to properly locate the strip of interlining 36 at the sewing needle 45.

The screw 95 as seen more clearly in FIG. 6, attaches the rod 94 to the sleeve 96 permanently affixed to the connecting plate 97. The bolts 101, in turn, attach the connecting plate 97 to the sliding plate 105 and the runner 106. Similarly, the bolts 107 attach the sliding plate 105 to the runner 108. The runners 106 and 108 sit in slots below the cover plate 109. They have a sufficiently large size that they cannot egress through the openings 110 and 111, respectively. As a result, they only permit motion of the sliding plate 105 laterally to the left or right in FIG. 6 but not vertically or rotationally.

Thus, as the sliding plate 105 moves to the left, it forces the connecting plate 97, the rod 94 and, consequently, the edge guide 93 to move in the same direction. This has the effect of reducing the size of the outlet opening 89 for the interlining strip 36, Similarly, as the sliding plate 105 moves to the right, it causes the edge guide 93 to increase the size of the opening for the strip 36.

The runner plate 105 in turn connects to the flat rod 114 which sits in the shaft formed by the attachment of the inverted U-shaped bracket 115 to the cover plate 109 by the bolts 116. As seen in FIG. 5, the bolts 117 attach the bottom retaining plate 118 to the inverted U-shaped bracket 115 to form a smaller shaft through which the flat rod 114 passes as well. The operator slides the flat rod 114 and thus the sliding plate 105 to the desired position to produce the desired size of the outlet 89. Tightening the wing nut 119 will lock the flat rod 114 in place. Conversely, loosening the wing nut 119 permits the operator, by grabbing the ball 120 to move the sliding plate 105, and thus the edge guide 93 in the outlet opening 89, to the correct location for the width of interlining strip 36 employed.

To further assist the operator, the bolts 107 attach the pointer 125 to the sliding plate 105. The pointer 125 thus moves to the left and right as does the sliding plate 105. As it does so, it points to a number on the ruler 126. This indicates the appropriate width of the strip of interlining 36 for the size of the outlet opening created by the edge guide 93.

Once inside the guide 69, the strip 36 must move toward the sewing needle 45. Furthermore, unlike the curtain 44 and the sewing guide material 32, a waistband only uses sections, rather than a continuous strip, of the interlining as seen in FIG. 1. Thus, at some point, during the formation of a waistband for a single pair of slacks, sections of the strip 36 must be severed from the remainder. After the severing, the guide 69 must reinsert the leading edge of the following section of the interlining 36 into the waistband at the correct location. As a result, the guide 69 must have some means for moving the waistband forward towards the sewing needle 45.

To accomplish this task, as seen in FIGS. 8 and 9, the guide 69 includes the air cylinder 31. The functioning of the cylinder 131 serves to extend and retract the piston 132.

Figure 10:
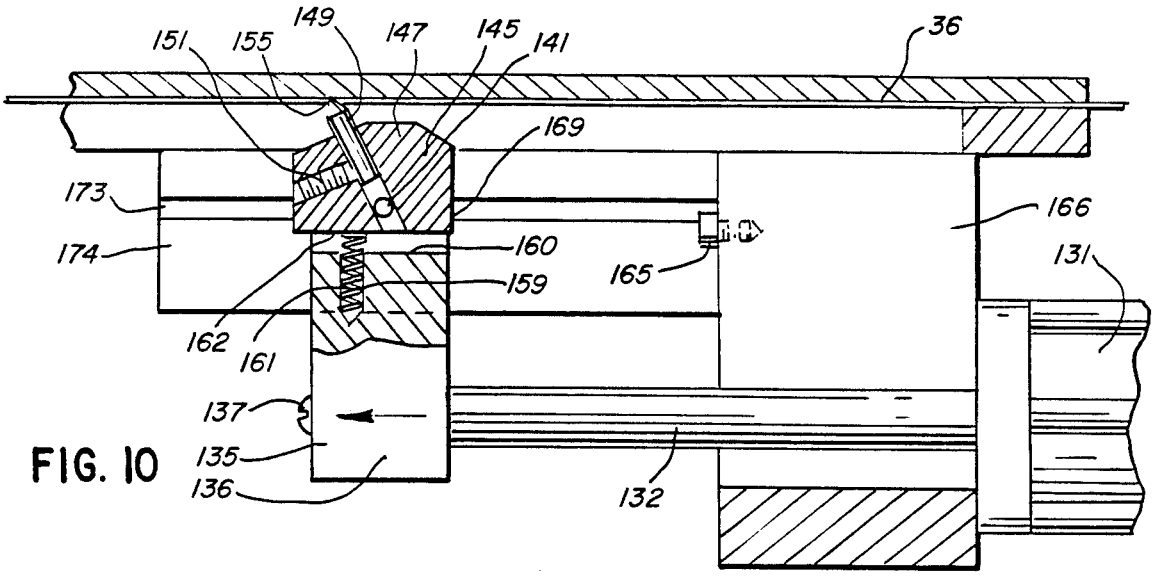
FIG. 10 gives a side plan view, partially in cross-section, of an injecting mechanism moving a strip of interlining towards the sewing area.
Figure 11:
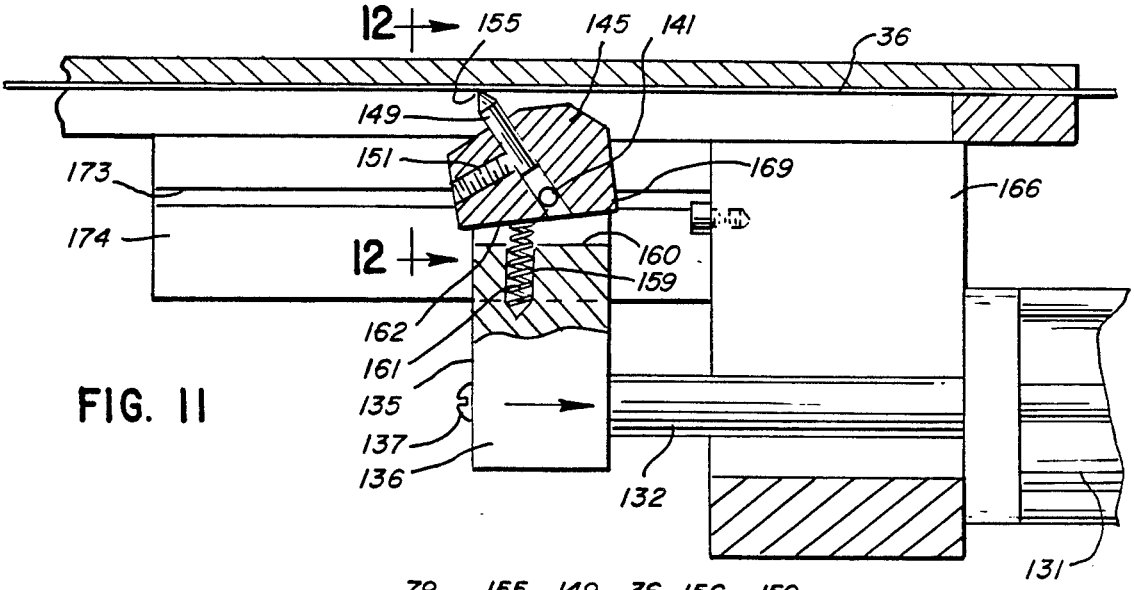
FIG. 11 shows the injecting mechanism of FIG. 10 moving in the opposite direction.
Figure 12:
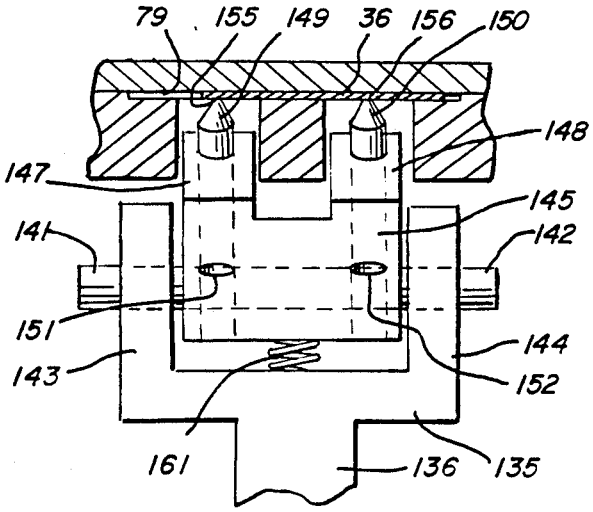
FIG. 12 gives a cross-sectional view along the line 12—12 of the sharp points and their holder of the injecting mechanism.

As seen in FIGS. 10 to 12, the piston 132 terminates at and ridgedly connects to the Y-shaped bracket 135. It specifically connects to the bottom leg 136 where the screw 137 helps keep it in place.

The screws 141 and 142 pass through the upper arms 143 and 144 of the holder 135, respectively, and have a journaled connection to the feeddog holder 145. In turn, the holder 145 includes the two projections 147 and 148 on its top in which sit the sharp dowels 149 and 150, respectively. The set screws 151 and 152 keep the dowels 149 and 150 in their respective projections 147 and 148, respectively.

When the pressure within the cylinder 131 extends the piston 132, the latter travels to the left as shown in FIG. 10. The bracket 135 and thus the holder 145 also travel in the same direction. When that occurs, the holder 145 pivots about its connection to the screws 141 and 142 in a clockwise direction as shown in FIG. 10. This in turn causes the points 155 and 156 of the sharpened dowels 149 and 150 respectively, to dig slightly into the interlining strip 36. With the points 155 and 156 thus attached to the interlining 36, the movement of the piston 131 and the holder 135 to the left causes the interlining strip 36 to move in the same direction toward the sewing needle.

The points 155 and 156 must at least make contact with the interlining strip 36 as the piston 132 begins to move to the left in FIG. 10. Otherwise, it will not necessarily attach to the interlining 36 to move it toward the sewing area. Thus, to provide a measure of assurance that the points 155 and 156 will make the desired contact with the strip 136, the bracket 135 includes the depression 159 drilled into the top of its crossbar 160. In the depression 159 sits the spring 161, under compression, which pushes against the bottom 162 of the holder 145. In particular, the spring 161 makes contact with the portion of the lower surface 162 to the left of the location of the pivot point 141. As a consequence, the spring 161 forces upward the left portion of the holder 145 as seen in FIGURE 10 and thus coaxes the points 155 and 156 into contact and engagement with the interlining strip 36.

When the piston 132 retracts into the cylinder 131, it causes the bracket 135 and the holder 145 to move to the right as seen, in particular, in FIG. 10. As it does so, the motion of the points 155 and 156 against the interlining strip cause the holder 145 to rotate in a counterclockwise direction as seen in FIG. 11. This counterclockwise rotational motion of the holder works against the biasing of the spring 161, but serves to free the points 155 and 156 from direct engagement with attachment to the interlining 36. This allows the bracket 135 and the holder 145 to move to the right of FIG. 11 as the cylinder 132 retracts the piston 131 without, however, causing the interlining 36 to move in the same direction, or away from the sewing needle.

Additionally, once the interlining 36 reaches the sewing needle 45, the sewing machine 43 will continue to feed it along with the other components of the waistband; the interlining at this point will require no further motivation from the holder 145. However, the ability of the holder 145 to rotate in the counterclockwise direction as seen in FIGS. 10 and 11 will permit the interlining 36 to pass over the points 151 and 152 regardless of the location of the piston 132 relative to the cylinder 131. Thus, while the piston may remain briefly in its extended position or sit at its retracted position, the interlining 36 may continue to feed to the sewing area.

As indicated above, when the bracket 135 and the holder 145 move to the right, the latter rotates in a counterclockwise direction as seen in FIG. 11 to disengage the points 155 and 156 from the interlining 136. At the limit of its motion to the right in FIG. 11, however, the screw 165 attached to the block 166 which holds the cylinder 131 abuts against the lower right edge 169 of the holder 145. This sharp contact between the screw 165 and the lower right edge 169 forces the holder 145 to undergo a sharp, quick clockwise rotation. This rotational motion, in turn, forces the points 155 and 156 upward and into the interlining strip 36. This contact between the points 155 and 156 assures that, when the piston 132 again moves out of the cylinder 131 by travelling to the left, it will immediately engage and begin to move the interlining strip 36 in the same direction. Thus, the combined action of the screw 165 and the biasing spring 161 provide for a precise beginning of the motion of the interlining strip 36 with the piston 132 toward the sewing area.

After substantial use, the extended piston 132 could drop away from the interlining strip 36 and result in imprecise movement of the interlining. To preclude this undesirable result, the screw 141, which rotationally connects the holder 145 to the bracket 135, sits in the track 173 of the block 174. Similarly, the screw 142 extending beyond the right arm 144 of the bracket 135 sits in the track 175 in the block 176, as seen in FIG. 8. The screws 141 and 142, sitting within the tracks 173 and 175, prevent both the bracket 135, the holder 145, and thus the points 155 and 156 from falling away from their proper location relative to the interlining strip 136.

When a sufficient portion of the interlining strip 36 has become part of a waistband, it must be severed from the remainder of the interlining strip. The mechanism for accomplishing this objective appears in FIG. 8. There, the knife blade 181 attaches to the block 182 through the screws 183. The block 182, in turn, has a ridged connection to the rod 185.

As the rod 185 rotates, it will cause the blade 181 to move in close contact with the stationary knife blade 186 in a counterclockwise direction as seen in FIG. 8. This motion of the blade 181 against the stationary blade 186 cuts the extended portion of the interlining 36 in the sewing area from the remainder on the supply spool. When the rod 186 rotates in the clockwise direction in FIG. 8, the blade 181 moves away from the stationary blade 186 to permit further interlining 36 from passing out of the guide 69.

The other end of the rod 185 rigidly connects to the arm 187. The bolt 188 provides a journalled connection between the arm 187 of the rod 185 and the chain links 189 and 190. The bolt 191, in turn, provides a pivotal connection of the chain links 189 and 190 to the T-bar 192 rigidly connected to the piston 193 moving into and out of the cylinder 194.

When the piston 193 extends from the cylinder 194, it causes the T-bar 192, the chain links 189 and 190, and thus the arm 187 to move to the right in FIG. 9. This effectuates the counterclockwise rotation of the block 182 and thus the knife blade 181 to cut the interlining strip 36 seen in FIG. 8. Conversely, when the cylinder 194 retracts the piston 193, the T-bar 192, the links 189 and 190, and the arm 187 move to the left in FIG. 9 causing the clockwise rotation of the block 182 and the knife 181 in FIG. 8.

The rotational couplings of the links 189 and 190 to the arm 187 on the one hand and the T-bar 92 on the other accomodate the slight vertical motion of the arm 187 as it rotates in either direction. Thus, the cylinder 194 may remain fixed and experience no vertical forces because the chain links 189 and 190 rotate slightly about their couplings 191 and 188 to the T-bar 192 and the arm 187, respectively. Without the chain links 189 and 190, a direct connection between the arm 187 and the T-bar 193 would exert slight vertical stresses on the cylinder 194, causing it to deteriorate in use and, at the minimum, become less precise in its motions.

The spring 196 sits under compression between the arm 187 and the face 197 of the block 198. This forces the arm 187 and thus the rod 185, to which it rigidly connects, to the bottom as seen in FIG. 9. This in turn causes the knife blade 181 to abut closely against the stationary knife blade 186 to assure a clean and effective cutting of the interlining 36.

Figure 13:
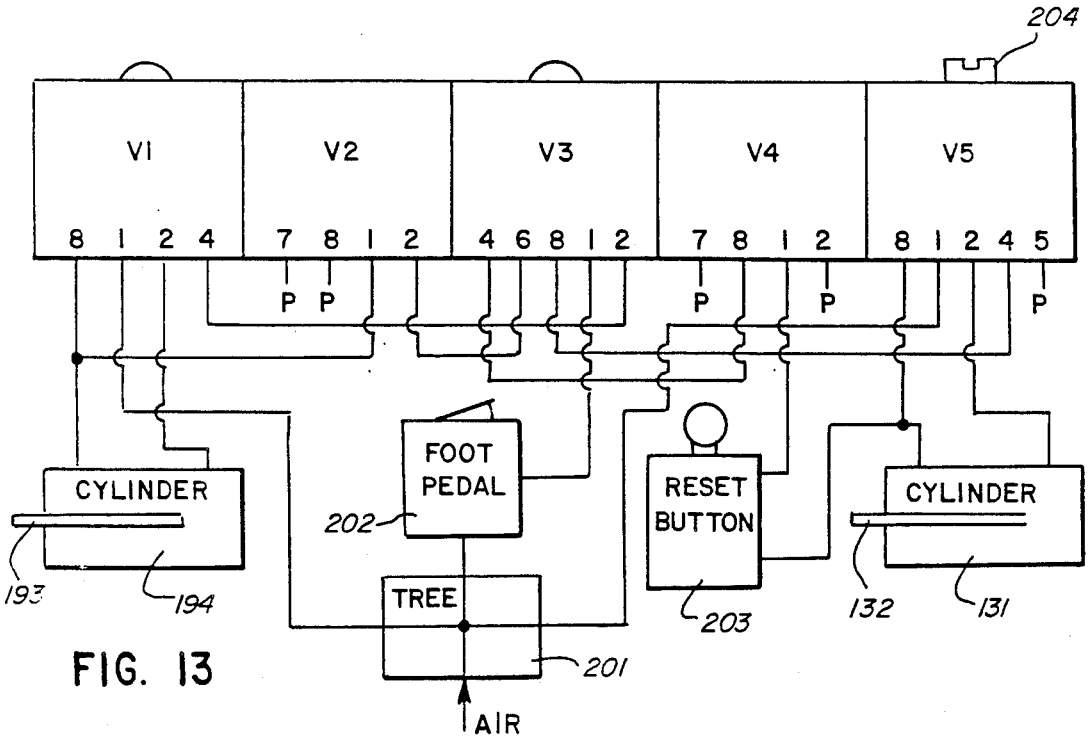
FIG. 13 provides a circuit diagram of the pneumatic system powering the interlining guide mechanism.

The logic controls for the cylinders 131 and 194 appear in FIG. 13. The diagram seen there actually represents a pneumatic logic circuit for controlling the operation of the cylinders 131 and 194. The power for this circuit comes from air pressure provided by the usual compressor to the branching tree 201. One branch from the tree 201 goes to the normally closed foot pedal switch 202 which, in turn, connects to the port 1 of the valve V3. The other branches of the tree 201 connect to the indicated ports of the valves V1 and V5. The only other control remaining available to the operator is the normally closed reset button switch 203.

Because the circuit operates under air pressure, various ports of the valves V2, V3, and V5 have received a plug, indicated by the letter P. As suitable components, the circuit shown in FIG. 13 includes the single pilot, four-way valve R401 for the shown component V1, the pulse valve R711 for the components V2 and V4, the double pilot four-way valve R402 for the component V3, and the single pilot, time delay, four-way valve R443 for the component V5. Clippard Instrument Laboratory, Inc., Cincinnati, Ohio, provides these valves.

In operation, depressing the foot pedel 202 activates one of the cylinders 131 and 194 and, on the subsequent depression, activates the other. The cycle continues, with subsequent depressions of the foot pedal 202 activating the cylinders 131 and 194 alternately. Specifically, depressing the foot pedal 202 activates, as appropriate, the cylinder 131 or the cylinder 194 by extending the piston 132 or 193, respectively. The piston 132 or 193 remains extended only during the time that the operator actually depresses the foot pedal 202. When she lets up on the foot pedal 202, the piston 132 or 193 as appropriate, returns to inside the appropriate cylinder.

Thus for example, when the operator depresses the foot pedal 202, the piston 132 leaves the cylinder 131. As discussed above, this causes the guide 69 to inject the beginning of the strip of interlining 36 toward the sewing needle 45. When the operator lets up on the foot pedal 202, the piston 132 retracts to within the cylinder 131. Upon the subsequent depression of the pedal 202, the piston 193 leaves the cylinder 194. This serves to cut a portion of the interlining 36 near the sewing needle from the remainder of the strip. Letting up on the foot pedal 202 causes the piston 193 to return to the cylinder 194 and return the knife to its resting position. The next depression of the foot pedal 202 then starts the cycle over by causing the piston 132 to insert new interlining 36 toward the sewing needle 45.

Thus, when the operator, while sewing a waistband, reaches the point where she wishes to insert interlining, she depresses the foot pedal 202 to start the strip 36. When she reaches the point in the waistband where the interlining should stop, she presses the foot pedal 202 again. This causes the cylinder 193 to activate the knife to cut the interlining 36. Obviously, she will repeat this process many times during a shift of work.

To start work at the beginning of a shift, however, the operator will typically place the interlining 36 manually at the location of the sewing needle. She will then commence sewing to create the waistband. Accordingly, she will wish to assure herself that the first time she actually depresses the foot pedal 202 will result in the knife cutting the interlining 36. To achieve this result, she will first, when starting operation, depress the reset button 203. This will set the valves V1 to V5 so that the first subsequent depressing of the foot pedal 202 will activate the knife.

Operators, naturally, have different techniques when utilizing the foot pedal 202. Some will hold it depressed for a period of time. This will assure that both the pistons 132 and 192 accomplish their purposes.

However, an operator may, in fact, have the habit of quickly releasing the foot pedal 202 almost immediately after depressing it. This pattern would have very little effect upon the operation of the knife operated by the piston 193. However, it could cause the piston 132 to retract within the cylinder 131 before it had inserted the interlining 136 all the way to the sewing needle. To prevent this from occurring for an operator, the time delay valve V5 includes the adjusting screw 204. Proper adjustment of the screw 204 on the time delay valve V5 will assure that the cylinder 131 remains powered sufficiently long to cause the piston 132 to fully extend and insert the interlining to the desired location in the sewing area. The change of operators on a particular machine would involve only a very minor adjustment.

I claim:

1. In a device for feeding a plurality of fabric strips to a sewing mechanism, said device including:

(1) first guiding means for directing a first strip of fabric to said sewing mechanism;

(2) second guiding means for directing a second strip of fabric to said sewing mechanism, said second guiding means including:

(a) injecting means for moving said second strip a predetermined distance in a particular linear direction toward said sewing mechanism; and (b) cutting means for severing a portion of said second strip near said sewing mechanism from the remainder of said second strip, the improvement wherein said injecting means comprises:

(A) transporting means for moving said predetermined distance in a substantially straight line in said particular linear direction toward said sewing mechanism and for moving away from said mechanism; and (B) gripping means, connected to and moving with said transporting means, for, when said transporting means moves in said particular linear direction, attaching to a particular location on said second strip and moving said second strip in said particular linear direction.

2. The improvement of claim 1 wherein said gripping means, when said transporting means moves in a direction other than said particular linear direction, releases said second strip.

3. The improvement of claim 2 wherein said transporting means, when moving away from said mechanism, moves in a direction substantially the reverse of said particular linear direction.

4. The improvement of claim 3 wherein said gripping means includes feed means having at least one sharp point partially directed toward both said second strip and toward said particular linear direction, said sharp point making contact with said second strip when said transporting means moves in said particular linear direction.

5. The improvement of claim 4 wherein said gripping means includes holding means, rigidly connected to said feed means and rotatably coupled to said transporting means, said holding means being rotatable between first and second positions and when in said first position, attaching to said second strip and, when in said second position, releasing said second strip.

6. The improvement of claim 5 wherein said injecting means further including directing means, slidably coupled to said holding means, for limiting the direction of nonrotational motion of said holding means to said particular linear direction.

7. The improvement of claim 5 wherein said gripping means further includes spring means for biasing said holding means towards said first position.

8. The improvement of claim 7 wherein said transporting means moves to a first limit in said particular linear direction and moves to a second limit in the reverse of said particular linear direction and further including abutting means, located at said second limit, for, when said holding means reaches said second limit, abutting against said holding means at a location to rotate said holding means toward said first position.

9. The improvement of claim 8 wherein said transporting means includes a cylinder and piston, with said transporting means reaching one of said first and second limits when said piston is extended from said cylinder and reaching the other of said first and second positions when said piston is retracted into said cylinder.

10. The improvement of claim 9 wherein, when said piston of said cylinder is extended from said cylinder, said transporting means reaches said first limit.

11. The improvement of claim 3 wherein said second guiding means further includes inlet means for the introduction of said second strip to said injecting means, said inlet means having an opening thereto and restricting means with spring biasing located in front of said opening of said inlet means, for limiting the size of said opening to said inlet means, said spring biasing forcing said restricting means in a direction to limit the area of said opening, said spring biasing being overcome by manual pressure to remove said restricting means from said opening.

12. The improvement of claim 11 including lever means, coupled to said spring-biased restricting means, for moving said restricting means out of said opening of said inlet means.

13. The improvement of claim 3 wherein said cutting means includes (a) a knife blade rotatably connected at a point and located near said sewing mechanism; (b) rotating means including an air cylinder and piston; and (c) a chain link connection between said piston and said knife blade, said piston, when moving from a position retracted within said air cylinder to a position extended from said cylinder, acting through said chain link to move said knife to cut said second strip.

14. In a method for feeding fabric strips to a sewing mechanism including:

(1) directing a first strip of fabric to said sewing mechanism; and (2) directing a second strip of fabric to said sewing mechanism, the step of directing said second strip including:

(a) moving said second strip a predetermined distance in a particular linear direction toward said sewing mechanism; and (b) severing a portion of said second strip near said sewing mechanism from the remainder of said second strip, the improvement wherein the step of moving said second strip said predetermined distance comprises:

(A) attaching a gripping means to said second strip at a particular location; and (B) moving said gripping means said predetermined distance in said particular linear direction.

15. The improvement of claim 14 further including the step of, when said gripping means moves in a direction other than said particular linear direction after moving in said particular linear direction, releasing said gripping means from said second strip.

16. The method of claim 15 further including, after said gripping means have moved in said particular linear direction, moving said gripping means in a direction opposite to said particular linear direction.

17. The improvement of claim 16 wherein said gripping means includes at least one sharp point and the step of attaching said gripping means to said second strip at said particular location is accomplished by placing said point in said second strip under force with said point directed partially toward said second strip and partially toward said particular linear direction.

18. The improvement of claim 17 wherein said point is held by holding means forming part of said gripping means and further including rotating said holding means between a first position where said point will attach to said second strip and a second position where said point will release said second strip.

19. The improvement of claim 18 further including biasing said holding means toward said first position where said point will attach to said second strip.

20. The improvement of claim 18 further including limiting the nonrotational motion of said holding means to said particular linear direction.

21. The improvement of claim 18 further including stopping the motion of said gripping means in the reverse of said particular direction at a predetermined location, and, when said gripping means reaches said particular location when moving in the reverse of said particular linear direction, contacting said holding means in a manner to move said point to said first position where said point will attach to said second strip.

22. The improvement of claim 16 wherein the moving of said gripping means is accomplished by extending a piston from and inserting said piston into a cylinder.

23. The improvement of claim 22 wherein said piston is extended from said cylinder to move said gripping means in said particular linear direction and said piston is retracted into said cylinder to move said gripping means in the reverse to said particular linear direction.

24. The improvement of claim 16 wherein the step of directing said second strip of fabric to said sewing mechanism includes introducing said second strip into an inlet opening after passing it by an obstruction placed in front of said inlet opening and further including the step of pushing against said obstruction to at least partially remove said obstruction from said inlet opening.

25. The improvement of claim 24 further including moving a lever connected to said obstruction against a spring biasing to move said obstruction out of said inlet opening.

* * * * *